United States Patent [19]

Torstensson

[11] 4,332,172

[45] Jun. 1, 1982

[54] DEVICE FOR DETERMINING THE PORE WATER PRESSURE IN A SOIL

[76] Inventor: Bengt-Arne Torstensson, 34 Höjdvägen, Vallentuna, Sweden, S-186 00

[21] Appl. No.: 177,761

[22] PCT Filed: May 22, 1979

[86] PCT No.: PCT/SE79/00117

§ 371 Date: Jan. 7, 1980

§ 102(e) Date: Jan. 7, 1980

[87] PCT Pub. No.: WO79/01099

PCT Pub. Date: Dec. 13, 1979

[30] Foreign Application Priority Data

May 22, 1978 [SE] Sweden ..... 7805815

[51] Int. Cl.[3] ..... G01L 11/00

[52] U.S. Cl. ..... 73/707; 73/73; 73/700

[58] Field of Search ..... 73/73, 756, 715, 707, 73/700

[56] References Cited

U.S. PATENT DOCUMENTS

| | | | |
|---|---|---|---|
| 1,856,695 | 5/1932 | De Florez | 73/707 |
| 2,017,365 | 10/1935 | Klein | 73/756 |
| 2,878,671 | 3/1959 | Prosser | 73/73 |
| 3,043,133 | 7/1962 | Richards | 73/73 |
| 3,091,115 | 5/1963 | Roberts | 73/73 |
| 3,178,944 | 4/1965 | Templeton | 73/756 |
| 3,318,140 | 5/1967 | Shields | 73/73 |
| 3,374,664 | 3/1968 | Lefelholz | 73/73 |
| 3,456,509 | 7/1969 | Thordarson | 73/715 |
| 3,574,284 | 4/1971 | Thordarson | 73/715 |
| 4,068,525 | 1/1978 | Skaling | 73/73 |

FOREIGN PATENT DOCUMENTS

| | | | |
|---|---|---|---|
| 389923 | 11/1976 | Sweden . | |
| 637741 | 12/1978 | U.S.S.R. | 73/756 |

*Primary Examiner*—Kyle L. Howell
*Assistant Examiner*—Denis E. Corr
*Attorney, Agent, or Firm*—Burns, Doane, Swecker & Mathis

[57] ABSTRACT

A device for measuring pore water pressure in soils employs a pore pressure sound (2) as a sensing member and a closed measuring system (5,6) for creating the least possible disturbance in soils having a low degree of permeability, such as clay. The closed liquid-filled measuring system comprises a hypodermic needle type (20) of connection between the pore pressure sound and a measuring device (3), said needle being operative to penetrate a member of resilient material to extend into a liquid-filled chamber in said pore pressure sound and transfer a reading of the pore water pressure to said measuring device.

11 Claims, 7 Drawing Figures

DEVICE FOR DETERMINING THE PORE WATER PRESSURE IN A SOIL

This invention relates to a device for determining the pore water pressure in a soil, and more particularly in clay.

At present there are a large number of different methods of determining pore water pressure. A distinction is made between open and closed measuring systems. In a closed measuring system only a small change in volume is needed for recording the pressure, whereas in an open system a large change in volume is necessary. This invention is primarily intended for the measurement of the pore water pressure in clays, and comprises a closed measuring system.

In the Swedish Patent specification with the publication No. 389 923 there is disclosed a method and a device for determining the pore water pressure in a soil. The measuring system comprises a closed system and is characterized by a measuring device which is connected by means of a nipple to the pore pressure sound. When a stabilized pore pressure reading is obtained, the measuring device is disconnected, and a sealing device which closes the nipple is connected to the nipple on the pore pressure sound. At the next measuring occurrence the sealing device is first removed, and the measuring device is thereafter connected to the pore pressure sound, etc. From the removal of the sealing device until the application of the measuring device to the pore pressure sound a certain time passes, which signifies that the initial pressure in the pore water adjacent the pore pressure sound is changed. This means that one has to wait a certain time before a stabilized reading of the pore pressure can be recorded. If the soil consists of clay, it is necessary when using the measuring system according to the said patent to wait about 15 to 20 minutes for obtaining a stabilized reading.

The object of the present invention is to provide an improvement of the existing measuring system, primarily with a view to make possible a considerable shortening of the necessary waiting period for obtaining a stabilized measuring value. This object of the invention and others are attained by a device having the features claimed in the appended claims.

BRIEF DESCRIPTION OF THE DRAWINGS

Below embodiments of the new invention will be described with reference to the drawings on which

DETAILED DESCRIPTION OF THE PREFERRED EMBODIMENTS

Figure 1:
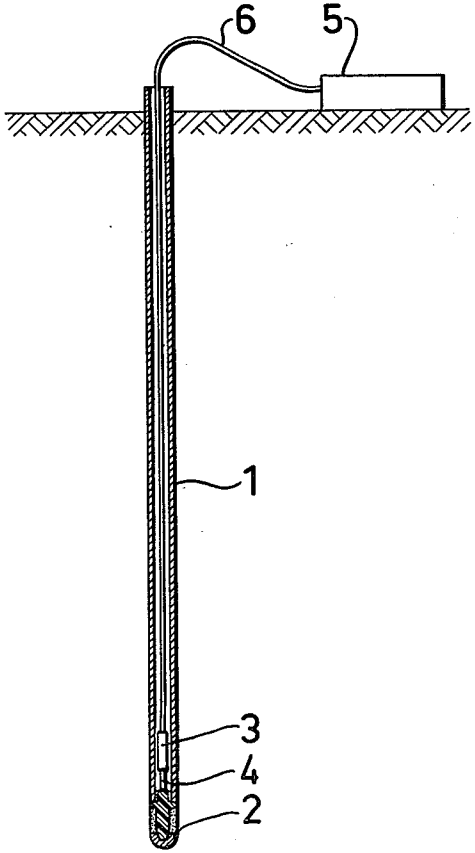
FIG. 1 shows an embodiment of the device according to the invention.

The basic structure of the device shown in FIG. 1 corresponds to the one according to the Swedish Pat. No. 7506203-4. Thus, a liquid-filled tube 1 is sunk into the ground. At the lower end of tube 1 a pore pressure sound is fitted, of which embodiments will be described in greater detail with reference to FIGS. 2, 3, 4, 5 and 7.

The structure shown in FIG. 1 further includes a measuring device 3 which has been lowered down into the tube 1, with via a sealing connection is fitted on the pore pressure sound 2. The measuring device 3 is connected to an electronic recording device 5 via a cable 6.

Figure 2:
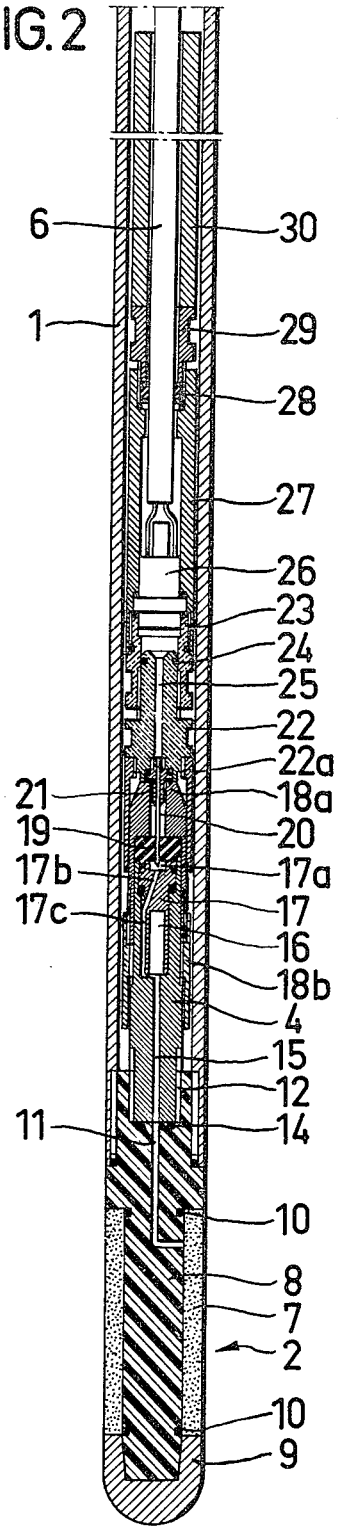
FIG. 2 is on a larger scale a cross section view through an embodiment of the pore pressure sound and the measuring device connected together.
Figure 3:
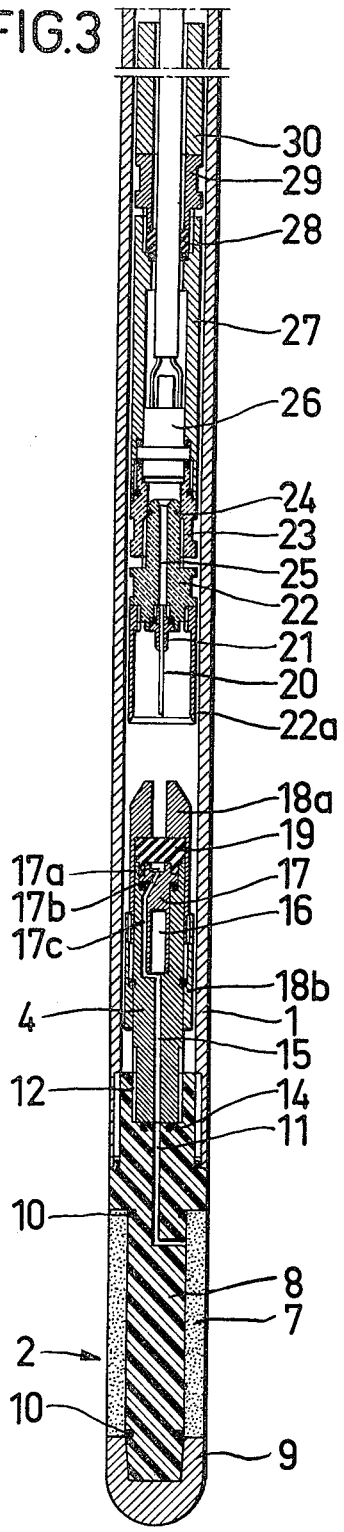
FIG. 3 on a larger scale is a cross section view of an embodiment of the pore pressure sound and the measuring device disengaged from each other.

The embodiment shown in detail in FIGS. 2 and 3 includes a pore pressure sound 2, which has a filter 7, preferably of a ceramic material, which partly encloses a sound tip 8, preferably of thermoplastics. At the lower end of the sound tip 8 a protection sheath 9 is mounted, which is pressed on. The filter 7 engages at its end surfaces O-rings 10 at the sound tip 8.

In the sound tip 8 a channel 11 extends from the filter 7 and debouches in the bottom of a threaded recess 12 in the upper portion of the sound tip 8.

The nipple 4 is screwed into the recess 12 and sealingly abouts an O-ring 14 at the bottom of the recess 12. In the nipple 4 a channel 15 also extends, which is a continuation of the channel 11 and which debouches in a chamber 16 of the nipple 4. In the chamber 16 a sleeve 17 is mounted having the function of a damping device. Further reference will be had thereto as the specification proceeds.

The nipple 4 also comprises two clamping sleeves **18*a* and 18*b*, which hold a rubber-cork 19 in the nipple 4**.

The measuring device 3 according to FIGS. 2 and 3 has mounted at its lower end a hypodermic needle 20 which by means of a threaded union 21 is tightly connected to a piston nipple 22. To the piston nipple 22 an aligning sleeve **22*a* is fitted, which facilitates the application of the measuring device 3 to the nipple 4. The piston nipple 22 is by means of a thread adjustably connected to a cylinder 23. An O-ring 24 sunk into the piston nipple 22 seals the connection between the piston nipple 22 and the cylinder 23. Via a channel 25 in the piston nipple 22 the needle 20 is connected to a pressure transmitter 26, which is mounted in a transmitter house 27 having at its top a seal in the form of a rubber gasked 28 and a nut 29. The gasket 28 serves also to relieve the cable 6. On the top of the nut 29 there is mounted a weight 30 which is needed for making the needle 20 penetrate the rubber-cork 19**.

Before the described pore pressure sound 2 is installed in the soil it must be filled with liquid, and all enclosed air must be vented off in the filter 7 as well as in the channel 11 and its continuation 15 in the nipple 4.

The filling of liquid and venting of air can for instance be carried out by the boiling of the whole pore pressure sound. This is done before fitting the sleeve 17 and the rubber-cork 19 to the nipple 4. When the pore pressure sound 2 has become water-saturated and has been vented it is held vertically, completely immersed in water, the sleeve 17 being introduced into the nipple 4. In connection with the introduction of the sleeve 17 into the nipple 4 a certain quantity of air will be enclosed in a controlled manner in the cylindrical cavity of the sleeve 17. This air volume serves as a damping element (to be described in greater detail below) in connection with the taking of a reading.

After the sleeve 17 has been inserted in the nipple 4, the rubber-cork 19 is fitted at its place, attention being paid that the upper cylindrical cavity 17*a* of the sleeve, its channel 17*b* and the slot 17*c* along its generatrix are completely filled with liquid. As apparent from FIGS. 2 and 3 the channel 17*b* and the slot 17*c* connect the upper cylindrical cavity 17*a* with the channel 15 of the nipple 4. The rubber-cork 19 is thereafter secured with the clamping sleeves 18*a* and 18*b*.

When these measures have been taken, the pore pressure sound 2 with its tube 1 is ready for being installed in the soil, care being taken that any air will not enter the pore pressure sound 2 in connection with the installation. This can for instance be achieved by enclosing the lower part of the pore pressure sound in a thin rubber skin, which during the initial penetration of the pore pressure sound 2 is worn away by the surrounding soil.

The measuring device 3 must also be prepared before a reading can be taken. Thus, it is of the greatest importance that the needle 20, the channel 25 and the cylinder 23 are completely filled with liquid. If this is not the case, i.e. if there are gas bubbles enclosed in the measuring device 3 a rather long time is required for recording a stable reading.

For making it possible to check the presence of gas bubbles the piston nipple 22 and the cylinder 23 should be made of a transparent material, for instance perspex. If such a check shows that gas bubbles are enclosed in the measuring device 3, the bubbles can be removed in a simple manner by the measuring device 3 being held upside down, the piston nipple 22 simultaneously being turned clockwise (for a right-hand thread), the piston nipple 22 thereby being moved farther into the cylinder 23, and the gas bubbles, collected at the top being forced out through the needle 20 together with liquid. When measurings are effected consecutively at several pore pressure sounds with the same measuring device 3, it is preferred after taking each separate reading to turn the piston nipple 22 clockwise, for example one quarter of a revolution. When the piston nipple has reached its bottom position it is screwed out of the cylinder 23, and fresh liquid is filled in.

When a pore pressure sound is being installed which in the present instance is usually effected by forcing the sound downwards into the ground, a disturbance of the pore pressure condition is induced in the ground close to the tip. Depending on the character of the soil and the sound dimension, a shorter or longer time will elapse before an equilibrium of the pore pressure is established, i.e. when the disturbance caused by the act of installation has been completely eliminated. For instance, in a highly plastic normal-consolidated clay about one week is needed for eliminating the disturbance effect. In sand, on the contrary, the disturbance effects may have been attenuated already one hour or so after installing the pore pressure sound.

When the pore pressure in the ground adjacent the sound 2 has attained a condition of equilibrium, a reading can be taken. This is effected, in principle, in the matter described in Swedish patent specification No. 7506203-4. Thus the needle 20 penetrates through the rubber-cork 19, whereafter a reading of the pressure in the liquid enclosed in the sound 2 is recorded. The pressure is equal to the desired pore pressure on account of the function of the filter 7.

As described above the rubber-cork 19 is held in position by clamping sleeves 18*a* and 18*b*, whereby radial stresses are induced in the rubber material that enables a sealing engagement of the needle 20 in the rubber-cork 19. When the needle 20 is pulled out of the rubber-cork 19 the radial stresses referred to above will cause an automatic closure of the pore pressure sound 2. The rubber-cork 19 can be said to function like a check valve which will close automatically when the needle 20 is removed. By adequate pretensioning of the rubber-cork 19 measurements can be carried out hundreds of times without the cork losing its check-valve function.

After the recording of a pore water pressure reading the needle 20 is lifted so as to lose its engagement with the rubber-cork 19. After that, another recording is made whereby a reading of the water pressure in tube 1 is obtained. Since this water pressure is known when the height of the tube 1 is known the pore pressure can be calculated as follows:

$$u = p_o + k(m_1 - m_2) + \Delta h$$

wherein $u$ = pore water pressure
$p_o$ = water pressure in tube
$k$ = calibration coefficient for measuring system
$m_1$ = reading of pore water pressure
$m_2$ = reading of water pressure in tube
$\Delta h$ = distance between pressure meter and centre of filter.

The readings referred to above thus are readings obtained with measuring device 3. These readings thereafter are transformed by multiplying with the calibration coefficient to a pressure in appropriate units, for example height of water column in centrimeters.

The method described above is very simple to practise for the staff working in the field. Only two readings are recorded, one of the pore water pressure and one of the water pressure in the tube, and as is seen from the formula above only the difference between the readings is used. Hence, one is not dependent on a checking of the zero reading of the measuring system.

In conjunction with the carrying out of a measurement it is highly important the measuring device 3 can be connected to nipple 4 with the least possible disturbance (change) of the pore pressure in the soil surrounding the pore pressure sound. This is of particular importance when measuring in clay where a disturbance of the pore pressure will entail a comparatively long wait before a stabilized reading can be attained.

The device illustrated in FIGS. 2 and 3 will enable the measuring device 3 to be coupled to nipple 4 with the least possible disturbance (change) of the pore pressure in the soil surrounding the pore pressure sound. This is made possible by the air mass enclosed in sleeve 17, which will assume a volume corresponding to the reigning pressure and will function as a damping means. In conjunction with the penetration of the rubber-cork 19 by the needle 20 a certain volume change of a resilient nature will take place by reason of the springy action of the rubber-cork. This volume change is accommodated to a wholly dominating degree by the air volume enclosed in sleeve 17 without any substantial change of the pressure condition of the enclosed liquid. Field trials have proved that a stable reading when measuring pore pressures in clay may be obtained already after some minutes. This means that the new invention provides a significant improvement of the device disclosed in Swedish patent specification No. 389,923 for which one has to wait 15 to 30 minutes when taking a corresponding measure, in order to obtain a stable reading.

Figure 4:
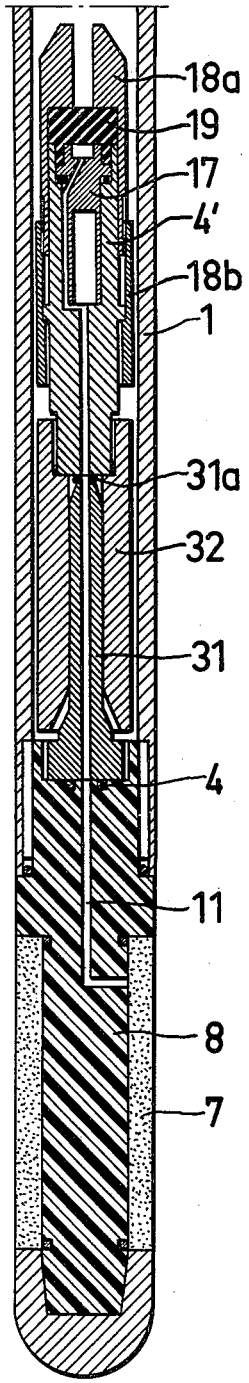
In FIG. 4 an alternative embodiment of the pore pressure tip is shown, to be used together with the device according to FIG. 1.

An alternative shape of the nipple 4' to be used with the device according to FIG. 1 is illustrated in FIG. 4. This embodiment differs from that one shown in FIGS. 2 and 3 therein that the nipple 4' is detachably connected to the pore pressure sound by means of a secondary nipple 31. A sealing engagement of the secondary nipple 31 is achieved with an O-ring 31a. The nipple 4' is guided centrally onto the secondary nipple 31 by means of a guide sleeve 32. This embodiment may be desirable if readings are taken during a very long time, since in that instance the nipple 4' may be lifted out of tube 1, when needed, e.g. for exchanging the rubber-cork 19.

Figure 5:
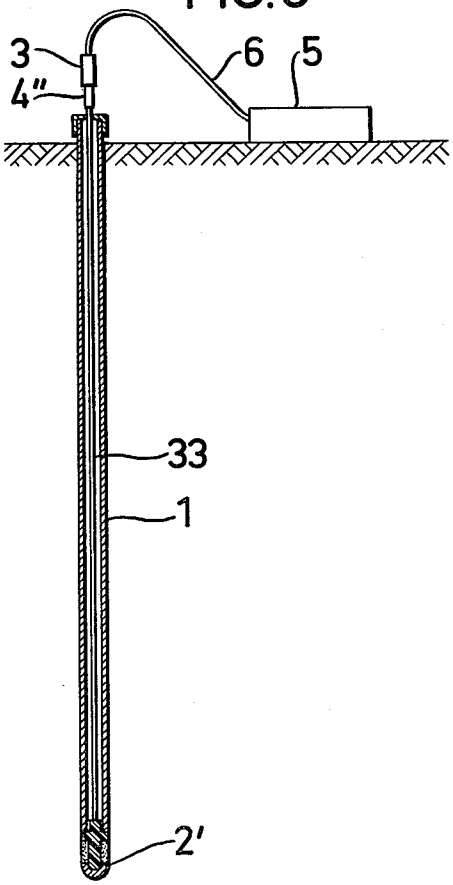
FIG. 5 shows an alternative embodiment of the device according to the invention.
Figure 6:
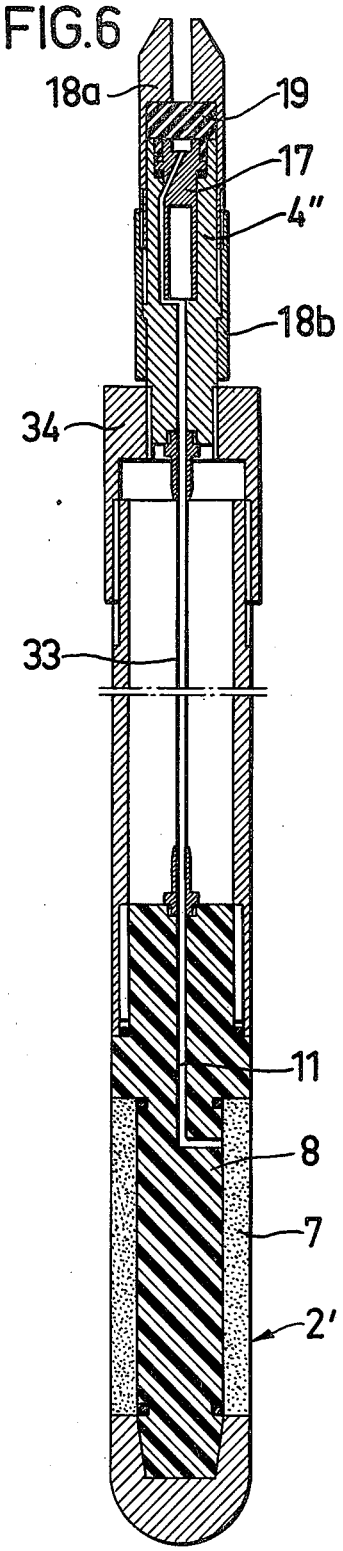
FIG. 6 is on a larger scale a cross-section view of an embodiment of the pore pressure sound, to be used in connection with the device according to FIG. 5.

In FIG. 5 there is shown an alternative shape of the structure according to FIG. 1. The nipple 4'' is provided at the top of tube 1 in this embodiment, instead of directly on the pore pressure sound 2'. The nipple 4'' in this embodiment is connected over a narrow liquid-filled tube 33 to the pore pressure sound 2'. FIG. 6 shows on a larger scale a cross-section of the measuring device of FIG. 5. The reading is taken in the same manner as for the embodiments disclosed above, i.e. through connecting the measuring device to nipple 4''. In the embodiment according to FIG. 6 the nipple 4'' has been coupled to the tube by means of an adapter 34.

Figure 7:
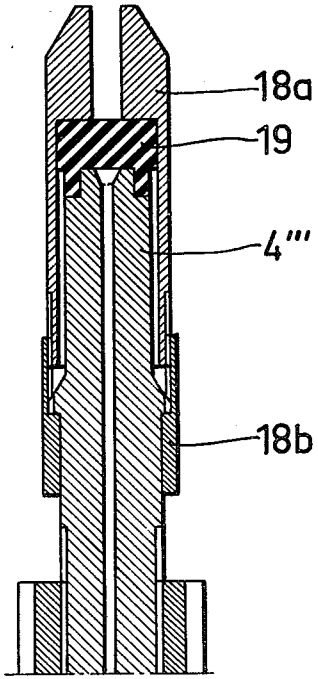
FIG. 7 is a cross-sectional view of, an alternative embodiment of the nipple 4 to be used with all the embodiments of the pore pressure sounds.

As printed out above it is of the greatest importance when measuring pore pressure in clay, that the measuring device 3 can be coupled to the nipple 4; 4'; 4'' with the least possible disturbance (change) of the pore pressure in the soil adjacent the pore pressure sound. By inserting the sleeve 17 in the nipple 4; 4'; 4'' acting as a damping means this requirement can be met. When measuring pore pressures in more water permeable soils than clay, such as sand and gravel, this requirement for a minimal disturbance on coupling the measuring device 3 to the nipple need not be satisfied. In such instance the sleeve 17 in the nipple can normally be left aside, and the nipple 4''' can be shaped as shown in FIG. 7. The nipple shape illustrated in FIG. 7 can be employed for all the structures and embodiments according to FIGS. 1 to 6. The structure described above thus permits the taking of readings much more quickly than possible with the device disclosed by Swedish patent specification No. 7506203-4, since with the device according to the invention one need not wait for any extended length of time for the reading of the pore pressure to become stabilized.

The principles, preferred embodiment, and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A device for determining the pore water pressure in a soil comprising a water-filled tube, a pore pressure sound at the bottom end of the tube having a filter, a measuring device with a pressure meter, means for connecting the measuring device to the pore pressure sound, cable means for connecting the measuring device to a recording means, the means for connecting the measuring device to the pore pressure sound comprises a hypodermic needle and a member of a resilient material, whereby to record a reading of the pore water pressure the hypodermic needle penetrates said member of resilient material, and damping means arranged on the pore pressure sound below said member for absorbing the effects of a momentary volume change in the pore pressure sound occurring during penetration of the needle through the resilient member, said damping means including a confined gas.

2. A device according to claim 1, wherein the hypodermic needle is provided at the measuring device, and the resilient member is connected to the pore pressure sound.

3. A device according to claim 2, further comprising an alignment sleeve surrounding the hypodermic needle, said sleeve being coupled on measuring to a nipple which is connected to the pore pressure sound.

4. A device according to claim 3, wherein the damping means is arranged on the nipple and includes means for enclosing on filling with liquid a predetermined volume of air in said nipple.

5. A device according to claim 4, wherein the air-enclosing means comprises a sleeve opening downwards.

6. A device according to claim 1, wherein the member of a resilient material comprises a rubber-cork which is mounted with a pre-tension radially with respect to the longitudinal axis of the pore pressure sound.

7. A device according to claim 1, wherein the pore pressure sound is a thermoplastic material.

8. A device according to claim 1, wherein the filter at the pore pressure sound is a ceramic material.

9. A device for determining the pore water pressure in a soil comprising a water-filled tube, a pore pressure sound at the bottom end of the tube having a filter, a measuring device with a pressure meter, means for connecting the measuring device to the pore pressure sound, cable means for connecting the measuring device to a recording means, the means for connecting the measuring device to the pore pressure sound comprises a hypodermic needle and a member of a resilient material, whereby to record a reading of the pore water pressure the hypodermic needle penetrates said member of resilient material, damping means for absorbing the effects of a momentary volume change in the pore pressure sound occurring during penetration of the needle through the resilient member, the hypodermic needle is mounted on a piston nipple which engages sealingly the inside of a cylinder and is displaceable in the cylinder, and said cylinder encloses a cavity.

10. A device for determining the pore water pressure in a soil comprising a water-filled tube, a pore pressure sound at the bottom end of the tube having a filter, a measuring device with a pressure meter, means for connecting the measuring device to the pore pressure sound, cable means for connecting the measuring device to a recording means, the means for connecting the measuring device to the pore pressure sound comprises a hypodermic needle and a member of a resilient material, whereby to record a reading of the pore water pressure the hypodermic needle penetrates said member of resilient material, damping means for absorbing the effects of a momentary volume change in the pore pressure sound occurring during penetration of the needle through the resilient member, the hypodermic needle is provided at the measuring device, and the resilient member is connected to the pore pressure sound, an alignment sleeve surrounding the hypodermic needle, said sleeve being coupled on measuring to a nipple which is connected to the pore pressure sound, the nipple is connected to the pore pressure sound over a secondary nipple.

11. A device for determining the pore water pressure in a soil comprising a water-filled tube, a pore pressure sound at the bottom end of the tube having a filter, a measuring device with a pressure meter, means for connecting the measuring device to the pore pressure sound, cable means for connecting the measuring device to a recording means, the means for connecting the measuring device to the pore pressure sound comprises a hypodermic needle and a member of a resilient material, whereby to record a reading of the pore water pressure the hypodermic needle penetrates said member of resilient material, damping means for absorbing the effects of a momentary volume change in the pore pressure sound occurring during penetration of the needle through the resilient member, the hypodermic needle is provided at a measuring device, and the resilient member is connected to the pore pressure sound, an alignment sleeve surrounding the hypodermic needle, said sleeve being coupled on measuring to a nipple which is connected to the pore pressure sound, the nipple is connected to the pore pressure sound over a flexible tube.

* * * * *